US007614737B2

(12) United States Patent
Ahne et al.

(10) Patent No.: US 7,614,737 B2
(45) Date of Patent: Nov. 10, 2009

(54) METHOD FOR IDENTIFYING AN INSTALLED CARTRIDGE

(75) Inventors: Adam Jude Ahne, Lexington, KY (US); George Chausanski, Lexington, KY (US); Jimish Doshi, Lexington, KY (US)

(73) Assignee: Lexmark International Inc., Lexington, KY (US)

( * ) Notice: Subject to any disclaimer, the term of this patent is extended or adjusted under 35 U.S.C. 154(b) by 364 days.

(21) Appl. No.: 11/303,275

(22) Filed: Dec. 16, 2005

(65) Prior Publication Data

US 2007/0139458 A1 Jun. 21, 2007

(51) Int. Cl.
*B41J 2/01* (2006.01)
*B41J 29/393* (2006.01)

(52) U.S. Cl. ..... 347/104; 347/19

(58) Field of Classification Search ..... 347/19, 347/86, 87, 67, 107, 157, 101, 104, 37, 2; 400/621; 234/35, 36, 37; 346/24
See application file for complete search history.

(56) References Cited

U.S. PATENT DOCUMENTS

| | | | | |
|---|---|---|---|---|
| 4,774,493 | A | 9/1988 | Rabinowitz | 340/310 |
| 4,902,880 | A | 2/1990 | Graczynski et al. | 235/375 |
| 6,022,094 | A | 2/2000 | Gibson et al. | 347/19 |
| 6,161,915 | A * | 12/2000 | Bolash et al. | 347/19 |
| 6,185,677 | B1 | 2/2001 | Nijhawan | 713/2 |
| 6,425,040 | B1 | 7/2002 | Dewa et al. | 710/303 |
| 6,477,602 | B1 | 11/2002 | Loison | 710/301 |
| 6,484,268 | B2 | 11/2002 | Tamura et al. | 713/600 |
| 6,547,356 | B2 | 4/2003 | Edelen et al. | 347/12 |
| 6,568,785 | B1 * | 5/2003 | Edelen et al. | 347/19 |
| 6,594,026 | B2 | 7/2003 | MacDonald | 358/1.12 |
| 6,601,940 | B2 * | 8/2003 | Akama et al. | 347/19 |
| 6,609,211 | B2 | 8/2003 | Atkinson | 713/323 |
| 6,614,545 | B1 | 9/2003 | Langer et al. | 358/1.15 |
| 6,636,922 | B1 | 10/2003 | Bastiani et al. | 710/305 |
| 6,654,896 | B1 | 11/2003 | Saunders et al. | 713/323 |
| 6,668,292 | B2 | 12/2003 | Meyer et al. | 710/61 |
| 6,672,699 | B1 * | 1/2004 | Jeong | 347/19 |
| 6,722,753 | B2 | 4/2004 | Helterline et al. | 347/19 |
| 6,749,281 | B2 * | 6/2004 | Asauchi | 347/19 |
| 6,768,952 | B2 | 7/2004 | Kantorovich et al. | 702/65 |
| 6,772,328 | B1 | 8/2004 | Talbot et al. | 713/1 |
| 6,816,977 | B2 | 11/2004 | Brakmo et al. | 713/323 |
| 6,865,684 | B2 | 3/2005 | Atkinson | 713/323 |
| 6,926,400 | B2 * | 8/2005 | Kelley | 347/104 |
| 6,945,645 | B2 | 9/2005 | Baron | 347/104 |
| 7,019,866 | B1 * | 3/2006 | Beck et al. | 358/1.8 |
| 2004/0223011 | A1 | 11/2004 | Adkins et al. | 347/7 |
| 2005/0000337 | A1 | 1/2005 | Ahne et al. | 83/76.1 |
| 2005/0001872 | A1 | 1/2005 | Ahne | 347/19 |
| 2005/0001891 | A1 * | 1/2005 | Ahne et al. | 347/104 |
| 2005/0057980 | A1 | 3/2005 | Ahne | 365/200 |

* cited by examiner

*Primary Examiner*—Stephen D Meier
*Assistant Examiner*—Rene Garcia, Jr.
(74) *Attorney, Agent, or Firm*—Taylor & Aust, PC

(57) ABSTRACT

A method for identifying an installed cartridge in a cartridge carrier of an imaging apparatus, wherein the imaging apparatus communicates with the installed cartridge over at least one line, includes sending an ID command to the installed cartridge via an ID line; and monitoring the ID line for an affirmative response from the installed cartridge, wherein the affirmative response over the ID line indicates that the installed cartridge is a perforator cartridge.

13 Claims, 4 Drawing Sheets

METHOD FOR IDENTIFYING AN INSTALLED CARTRIDGE

BACKGROUND OF THE INVENTION

1. Field of the Invention

The present invention relates to an imaging apparatus, and, more particularly, to a method for identifying an installed cartridge, such as for example, a perforator cartridge installed in the imaging apparatus.

2. Description of the Related Art

Various devices are available for performing perforation and/or cutting operations. However, many such devices are used in commercial applications, and are generally cost prohibitive to lower volume users. Also, such devices are often standalone devices, requiring the purchase of additional hardware. Some efforts have been directed to incorporating a perforation device into an imaging apparatus so as to facilitate both printing and perforating with the same imaging apparatus. Such an imaging apparatus may include, for example, a replaceable printhead cartridge.

SUMMARY OF THE INVENTION

The present invention, in one form thereof, is directed to a method for identifying an installed cartridge in a cartridge carrier of an imaging apparatus. The imaging apparatus communicates with the installed cartridge over at least one line. The method includes sending an ID command to the installed cartridge via an ID line; and monitoring the ID line for an affirmative response from the installed cartridge, wherein the affirmative response over the ID line indicates that the installed cartridge is a perforator cartridge.

The present invention, in another form thereof, is directed to an imaging apparatus. The imaging apparatus includes a cartridge carrier having a cartridge bay having an electrical interface including an ID line. The cartridge carrier is configured to interchangeably receive one of a printing cartridge and a perforator cartridge. The printing cartridge has electronic circuitry to facilitate an identification of the printing cartridge. The perforator cartridge has an internal electronic configuration that differs from that of the electronic circuitry of the printing cartridge. A controller is communicatively coupled to the electrical interface of the cartridge bay of the carrier and to an installed cartridge present in the cartridge bay. The controller executes program instructions to perform the acts of sending an ID command to the installed cartridge present in the cartridge bay via the ID line; and monitoring the ID line for an affirmative response from the installed cartridge, wherein the affirmative response over the ID line indicates that the installed cartridge is a perforator cartridge.

The present invention, in another form thereof, is directed to a perforator cartridge including a perforator mechanism having an ID line which when driven low performs a perforation operation.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the invention in any manner.

DETAILED DESCRIPTION OF THE INVENTION

Figure 1:
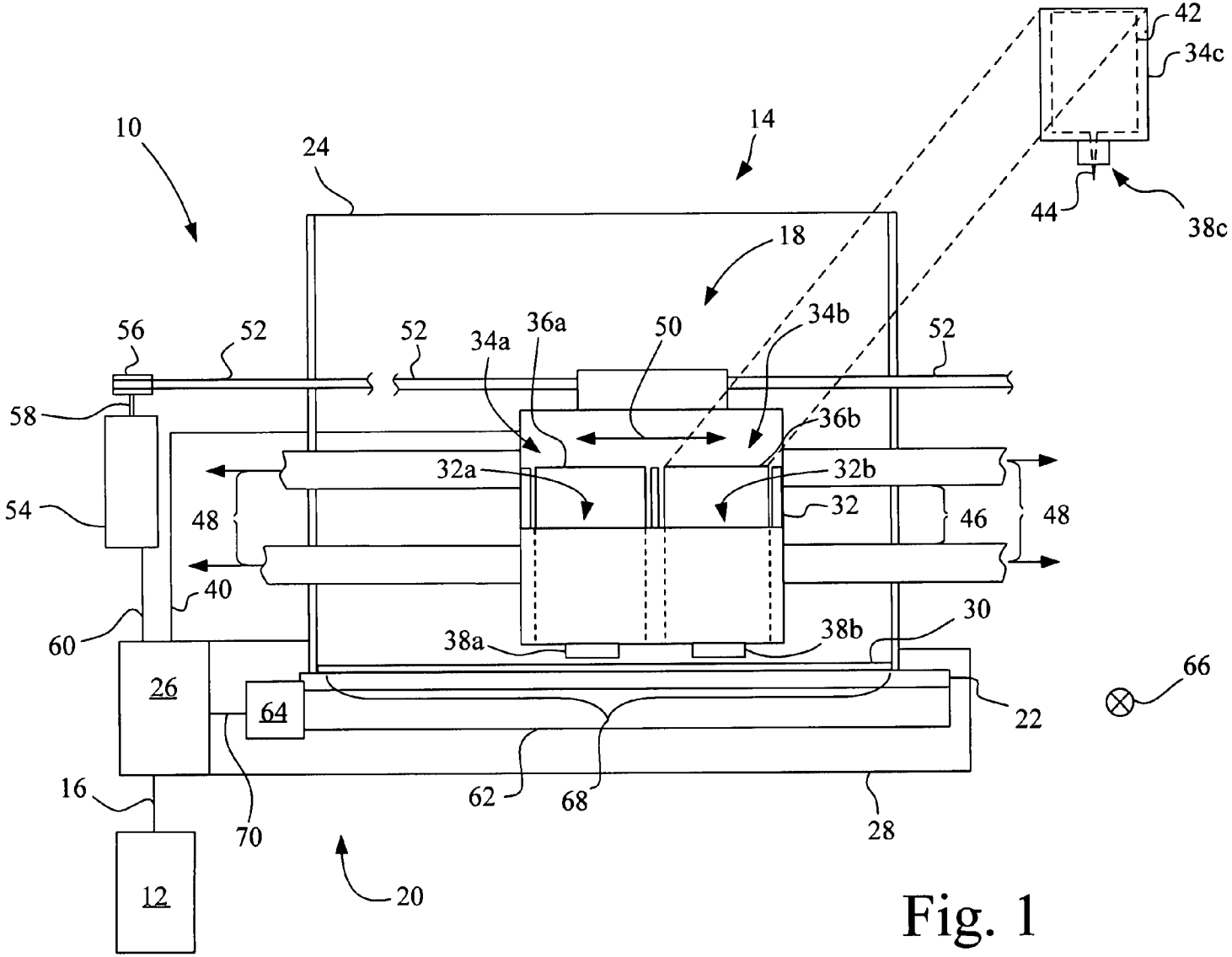
FIG. 1 is a diagrammatic representation of an imaging system including an imaging apparatus.

Referring now to the drawings and particularly to FIG. 1, there is shown an imaging system 10 employing an embodiment of the present invention. Imaging system 10 includes a computer 12 and an imaging apparatus 14. Computer 12 is communicatively coupled to imaging apparatus 14 by way of communications link 16.

As used herein, the term "communications link" generally refers to structure that facilitates electronic communication between two components, and may operate using wired or wireless technology. Accordingly, communications link 16 may be, for example, a direct electrical wired connection, a direct wireless connection (e.g., infrared or r.f.), or a network connection (wired or wireless), such as for example, an Ethernet local area network (LAN) or a wireless networking standard, such as IEEE 802.11.

Computer 12 is typical of that known in the art, and may include a monitor to display graphics or text, an input device such as a keyboard and/or mouse, a microprocessor and associated memory, such as random access memory (RAM), read only memory (ROM) and a mass storage device, such as CD-ROM or DVD hardware. Resident in the memory of computer 12 is driver software that places print data, print commands, perforation data and perforation commands in a format that can be recognized by imaging apparatus 14.

Imaging apparatus 14 includes a carrier system 18, a feed roller unit 20, a mid-frame 22, a media source 24, and a controller 26. Carrier system 18, feed roller unit 20, mid-frame 22, media source 24, and controller 26 are coupled, e.g., mounted, to an imaging apparatus frame 28.

Media source 24 is configured and arranged to supply from a stack of print media a sheet of media 30, such as paper, transparency, etc., to feed roller unit 20, which in turn further transports the sheet of media 30 during a printing operation and/or a perforation operation.

Carrier system 18 includes a cartridge carrier 32, i.e., a carriage, which is configured with one or more cartridge bays, for example cartridge bay 32*a* and cartridge bay 32*b*. Each of cartridge bays 32*a*, 32*b* is mechanically and electrically configured to mount, carry and facilitate one or more types of cartridges, such as a monochrome printhead cartridge 34*a* and/or a color printhead cartridge 34*b*, and/or a perforator cartridge 34*c*.

Monochrome printhead cartridge 34*a* includes a monochrome ink reservoir 36*a* provided in fluid communication with a monochrome ink jet printhead 38*a*. Color printhead cartridge 34*b* includes a color ink reservoir 36*b* provided in fluid communication with a color ink jet printhead 38*b*. Each of ink jet printheads 38*a* and 38*b* include a plurality of nozzles and associated electrical actuators for selectively ejecting drops of ink. In addition, each of printheads 38*a* and 38*b* has electronic circuitry with associated memory for storing and exporting printhead identification information, printhead alignment values, etc. The ink jet printheads 38*a*, 38*b* are electrically connected to controller 26 via a communications link 40.

Perforator cartridge 34*c* includes a perforator head 38*c* and a perforator mechanism 42. Perforator head 38*c* includes at least one perforation device 44, which may include one or more reciprocating needles or blades, used in forming perforations in the sheet of media 30. Perforator mechanism 42 includes a drive module for driving perforation device 44 in a reciprocating manner, and an electronics module for facilitating communications with controller 26. Perforator mechanism 42 is electrically connected to controller 26 via communications link 40.

Cartridge carrier 32 is guided by a pair of guide members 46. Either, or both, of guide members 46 may be, for example, a guide rod, or a guide tab formed integral with imaging apparatus frame 28. The axes 48 of guide members 46 define a bi-directional scanning path 50 of cartridge carrier 32. Cartridge carrier 32 is connected to a carrier transport belt 52 that is driven by a carrier motor 54 via a carrier pulley 56. In this manner, carrier motor 54 is drivably coupled to cartridge carrier 32 via carrier transport belt 52, although one skilled in the art will recognize that other drive coupling arrangements could be substituted for the example given, such as for example, a worm gear drive. Carrier motor 54 can be, for example, a direct current motor or a stepper motor. Carrier motor 54 has a rotating motor shaft 58 that is attached to carrier pulley 56. Carrier motor 54 is coupled, e.g., electrically connected, to controller 26 via a communications link 60.

During a printing operation or a perforation operation, cartridge carrier 32 is transported under the control of controller 26 along bi-directional scanning path 50, via the rotation of carrier pulley 56 imparted by carrier motor 54, in a reciprocating manner. Bi-directional scanning path 50, also referred to as the main scanning direction 50, is parallel with axes 48 of guide members 46, and is also commonly referred to as the horizontal direction.

During each scan of cartridge carrier 32, the sheet of media 30 is held stationary by feed roller unit 20. Feed roller unit 20 includes a feed roller 62 and a drive unit 64. The sheet of media 30 is transported in a media feed direction 66 through a print/perforation zone 68 by the rotation of feed roller 62 of feed roller unit 20. In FIG. 1, media feed direction 66 is represented as an X in a circle to indicate that the media feed direction is projected outwardly toward the reader. A rotation of feed roller 62 is effected by drive unit 64. Drive unit 64 is electrically connected to controller 26 via a communications link 70. Also, during each scan, the reciprocation of cartridge carrier 32 transports ink jet printheads 38*a*, 38*b*, and/or perforator head 38*c* over and across the sheet of media 30 along bi-directional scanning path 50, i.e., in the main scanning direction, through print/perforation zone 68. Main scanning direction 50 is substantially perpendicular to media feed direction 66.

Controller 26 may be in the form of an application specific integrated circuit (ASIC), and may include a processor, such as a microprocessor, and associated memory. Controller 26 is configured to execute program instructions to control and monitor the operation of imaging apparatus 14. For example, controller 26 supplies electrical signals to the ink jetting actuators of ink jet printheads 38*a*, 38*b* to effect the selective ejection of ink from monochrome ink jet printhead 38*a* and/or color ink jet printhead 38*b*. Also, for example, controller 26 supplies electrical signals to perforator mechanism 42 to initialize a perforation cycle using perforator cartridge 34*c*.

Figure 2A:
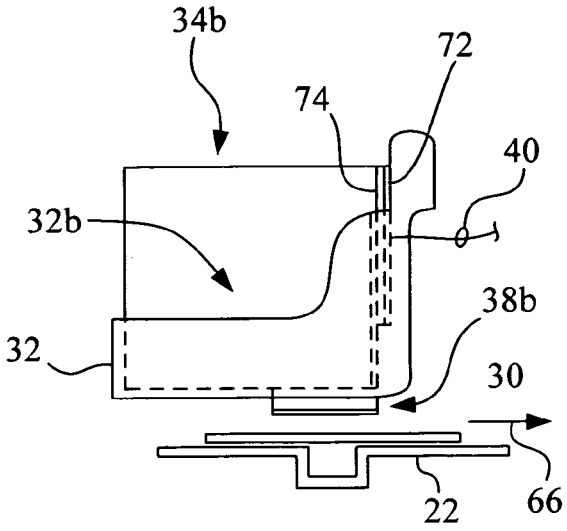
FIG. 2A is a side diagrammatic view of a replaceable printhead cartridge after being installed in a cartridge bay of the cartridge carrier of the imaging apparatus of FIG. 1.

Perforator cartridge 34*c* is sized and configured to be mechanically and electrically compatible with the configuration of at least one of the ink jet printhead cartridges 34*a*, 34*b* so as to be interchangeable therewith in cartridge carrier 32. For example, either of color printhead cartridge 34*b* or perforator cartridge 34*c* may be installed in cartridge bay 32*b*. FIG. 2A shows a side diagrammatic view of color printhead cartridge 34*b* after being installed in cartridge bay 32*b*, and FIG. 2B shows a side diagrammatic view of perforator cartridge 34*c* after being installed in cartridge bay 32*b*.

Figure 2B:
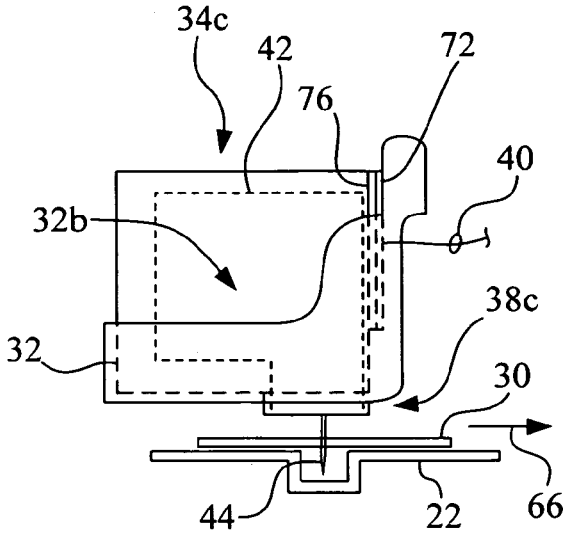
FIG. 2B is a side diagrammatic view of a perforator cartridge after being installed in the cartridge bay of FIG. 2A where the replaceable printhead cartridge was previously installed.

In the examples shown in FIGS. 2A and 2B, cartridge bay 32*b* includes an electrical interface 72 communicatively coupled to controller 26 via communications link 40. Referring to FIG. 2A, electrical interface 72 is electrically coupled to contact pads 74 of color printhead cartridge 34*b* when color printhead cartridge 34*b* is installed in cartridge bay 32*b*. Referring to FIG. 2B, electrical interface 72 is electrically coupled to contact pads 76 of perforator cartridge 34*c* when perforator cartridge 34*c* is installed in cartridge bay 32*b*.

Figure 3:
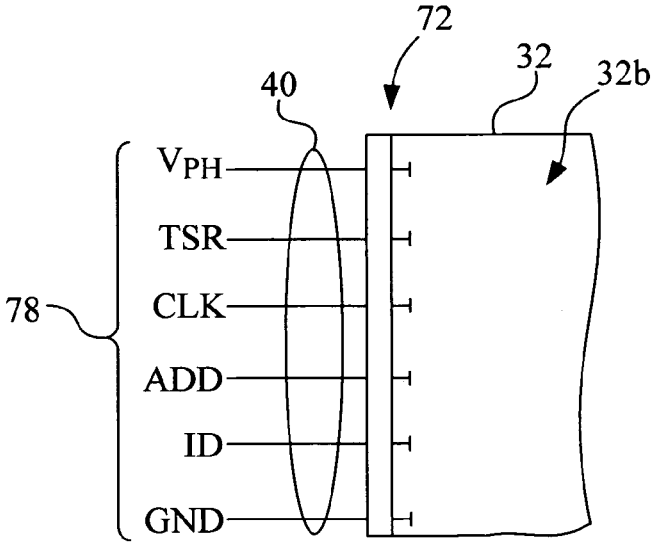
FIG. 3 is a diagrammatic representation of an electrical interface used with the cartridge bay of FIGS. 2A and 2B.

Referring to FIG. 3, electrical interface 72 includes a plurality of communication lines 78, including for example, a power line $V_{PH}$, a temperature sense line TSR, a clock line CLK, an address line ADD, an identification line ID (hereinafter ID line), and a ground line GND. Those skilled in the art will recognize that the plurality of communication lines 78 may include additional lines, if desired.

Referring again to FIG. 2A in conjunction with FIG. 3, controller 26 senses the presence of a cartridge, e.g., when color printhead cartridge 34*b* is installed in cartridge bay 32*b*, by a change of impedance sensed on temperature sense line TSR. Controller 26 then exercises address line ADD and clock line CLK to serially retrieve a cartridge identification number from the electronic circuitry present on color ink jet printhead 38*b* via the ID line. To this end, the electronic circuitry present on color ink jet printhead 38*b* may include, for example, one or more serial shift registers that provide the cartridge identification number as a serial data stream to controller 26.

The internal electronic configuration of perforator cartridge 34*c* differs from that the electronic circuitry present on color ink jet printhead 38*b*, and as such uses a different communication scheme, as more fully described below. However, perforator cartridge 34*c* communicates with controller 26 over the same electrical interface 72 that would be used, for example, by color printhead cartridge 34*b*. In other words, no special or dedicated electrical interface is required beyond that already provided by electrical interface 72.

Figure 4:
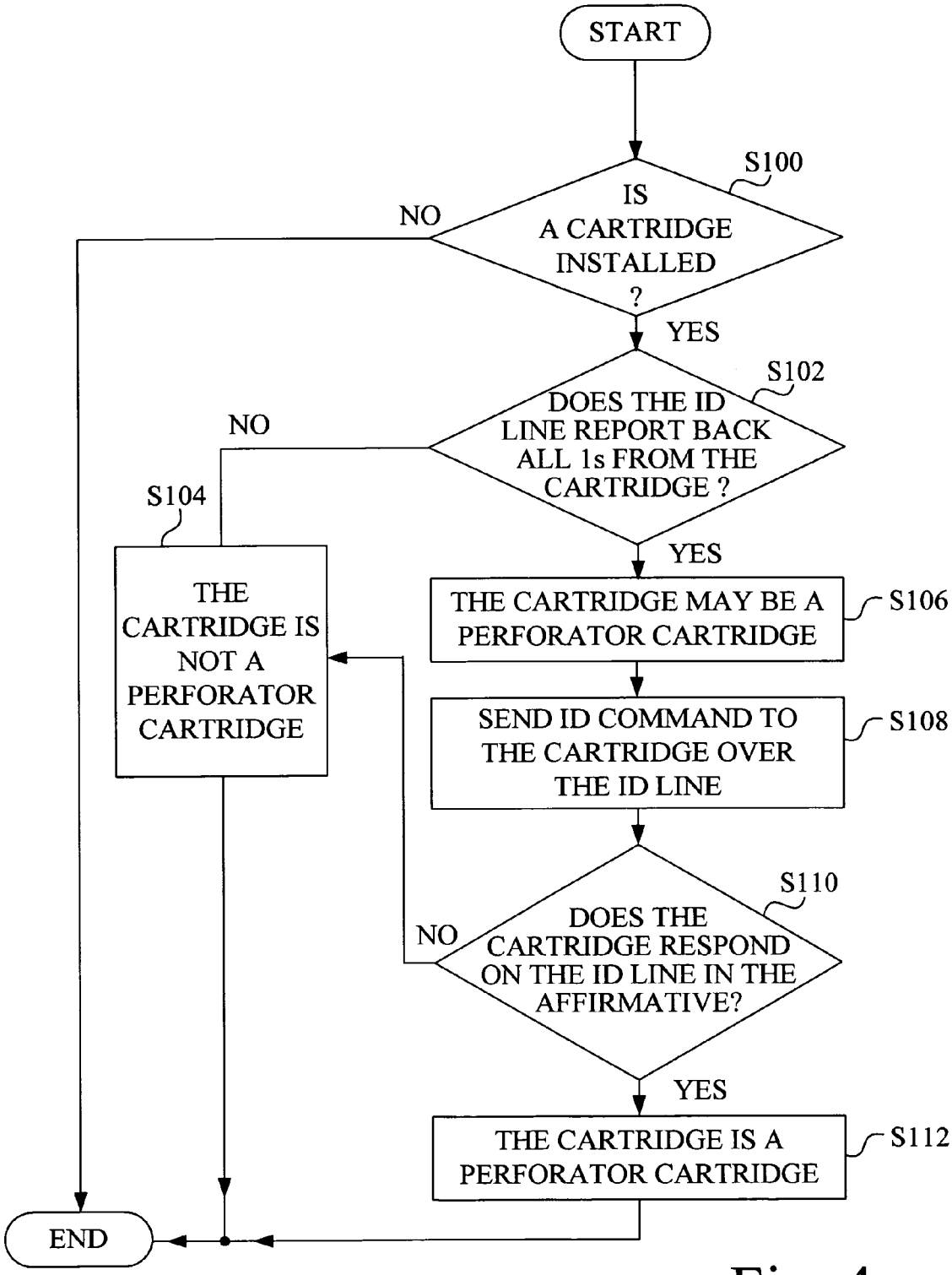
FIG. 4 is a flowchart of a method for identifying an installed cartridge in a cartridge carrier of the imaging apparatus of FIG. 1, in accordance with an embodiment of the present invention.

FIG. 4 is a flowchart of a method for identifying an installed cartridge in a cartridge carrier of the imaging apparatus of FIG. 1, in accordance with an embodiment of the present invention. The method may be implemented, for example, by program instructions executing on controller 26 of imaging apparatus 14, or alternatively, by program instructions executing on a controller of computer 12.

At step S100, it is determined whether a cartridge is installed in cartridge carrier 32, such as for example, in cartridge bay 32*b*. This determination may be made, for example, by turning on the power to the power line $V_{PH}$ and then monitoring the impedance of temperature sense line TSR.

For example, an impedance at a first level on temperature sense line TSR, such as a logic high (e.g., a logic "1"), may indicate that no cartridge, or an unrecognized cartridge, is installed in cartridge bay 32*b*, such that the determination at step S100 is NO, and the process ends.

However, an impedance at a second level on temperature sense line TSR, such as ground, may indicate that either a perforator cartridge or a printhead cartridge is installed in cartridge bay 32*b*, such that the determination at step S100 is YES. In other words, the impedance at the second level indicates the possibility that the installed cartridge is a perforator cartridge. Accordingly, if the determination at step S100 is YES, the process proceeds to step S102.

At step S102, controller 26 monitors the ID line to determine whether the ID line reports back at a predefined fixed logic level, e.g., all logic Is, or whether there is detected a serial data stream of another type.

For example, controller 26 may exercise address line ADD and clock line CLK and if a varying serial data stream is received over the ID line in response, then the serial data stream may be interpreted as a cartridge identification number for an ink jet printhead cartridge, such as color ink jet printhead cartridge 34*b*. In this case, the determination made at step S102 is NO, and the process proceeds to step S104, where it is determined that the installed cartridge is not a perforator cartridge, or is not a recognized perforator cartridge.

If the determination at step S102 is YES, then at step S106, it is determined that the installed cartridge may be a perforator cartridge, such as perforator cartridge 34*c*.

At step S108, controller 26 sends an ID command, as a serial data stream, over the ID line to the installed cartridge. The serial data stream may be, for example, in the form of a pulse width modulation (PWM) serial data stream, with a base frequency, for example, of 8 kilohertz (kHz). The minimum time between transitions may be, for example, 4 milliseconds (mS), and the maximum time may be unlimited. Also, for example, a 25 percent duty cycle of the PWM signal may represent a logic "0" and a 100 percent duty cycle of the PWM signal may represent a logic "1".

Accordingly, in the context of the present invention, the ID line and associated driver circuitry facilitates bi-directional communication over the ID line. The ID command may be, for example, a unique data word that only a perforator cartridge, such as perforator cartridge 34*c*, would interpret correctly.

At step S110, it is determined whether the installed cartridge responded to the ID command in the affirmative on the ID line.

For example, if there is no response over the ID line within a predetermined period of time, or an incorrect response is received on the ID line by controller 26, the determination at step S110 is NO and the process goes to step S104, where it is determined that the installed cartridge is not a perforator cartridge, or is not a recognized perforator cartridge.

If, however, the response received by controller 26 over the ID line is an affirmative response, e.g., a recognized data word response, the determination at step S110 is YES and then at step S112 it is determined that the installed cartridge is a recognized perforator cartridge, such as perforator cartridge 34*c*.

Once it is determined that the installed cartridge is a recognized perforator cartridge, e.g., perforator cartridge 34*c*, perforator control signals may be sent to perforator cartridge 34*c* to activate perforator mechanism 42 of perforator cartridge 34*c* to form perforations in the sheet of media 30 via perforation device 44.

Figure 5:
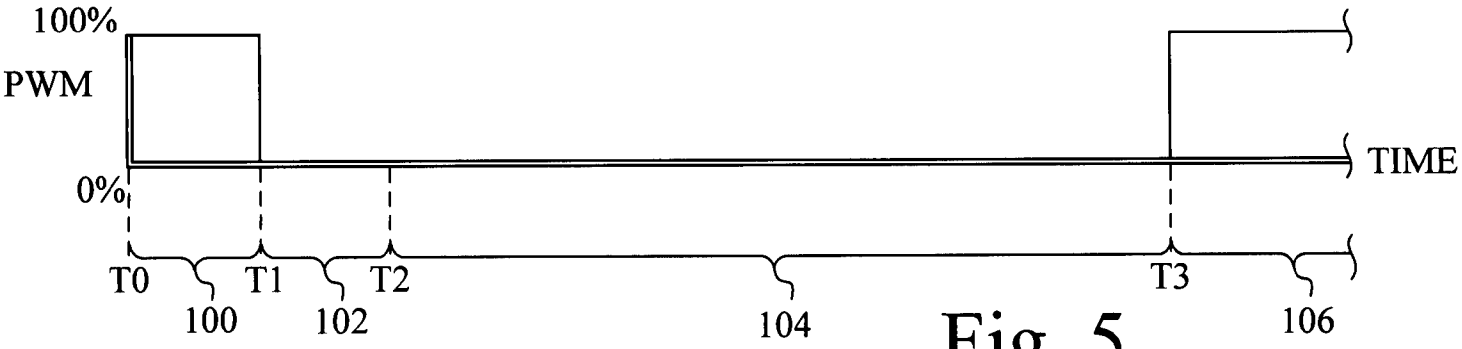
FIG. 5 is a graphical representation of an exemplary bidirectional communication between the imaging apparatus and the perforator cartridge over the ID line.

FIG. 5 is a graphical representation of an exemplary bi-directional communication between imaging apparatus 14 and perforator cartridge 34*c* over the ID line. When perforator cartridge 34*c* is in an idle state, the impedance of the ID line is pulled up by a resistor at perforator cartridge 34*c* to a 100 percent modulation level.

For example, as shown in FIG. 5, during period 100, between times T0 and T1, perforator cartridge 34*c* is in an idle state. At time T1, imaging apparatus 14 drives the ID line to ground (zero (0) percent modulation) for at least 4 mS during period 102 to trigger a perforation cycle that begins at time T2. During period 104, from time T2 to time T3, the perforation cycle is performed by perforator cartridge 34*c*. Also, during period 104, perforator cartridge 34*c* may drive the ID line to provide perforator cartridge 34*c* status information to controller 26 of imaging apparatus 14, such as for example, whether the perforation cycle is complete. At time T3, perforator cartridge 34*c* goes back to an idle state, i.e., period 106.

Figure 6:
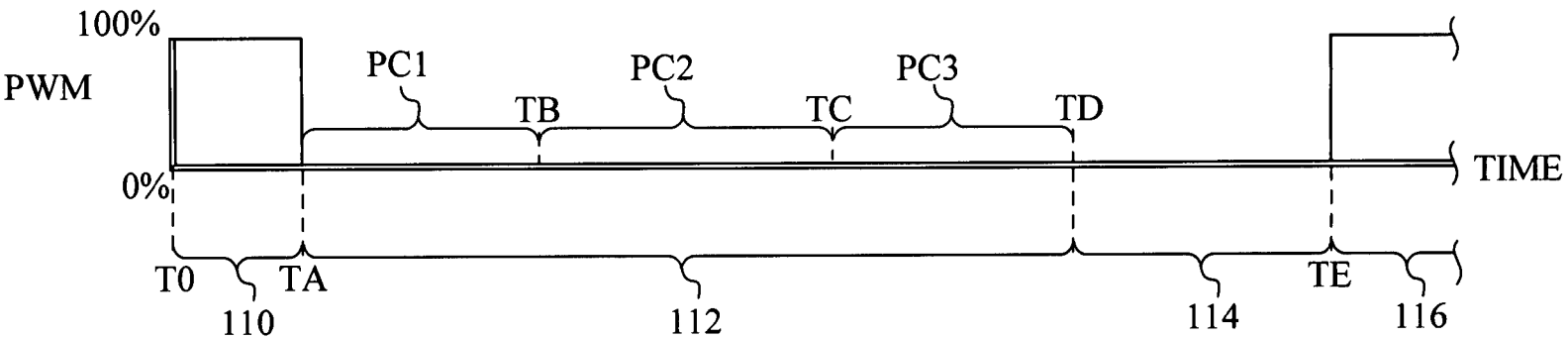
FIG. 6 is a graphical representation of an exemplary bidirectional communication between the imaging apparatus and perforator cartridge over the ID line, wherein multiple perforation cycles are performed.

FIG. 6 is a graphical representation of an exemplary bi-directional communication between imaging apparatus 14 and perforator cartridge 34*c* over the ID line, wherein multiple perforation cycles are performed.

For example, as shown in FIG. 6, during period 110, between times T0 and TA, perforator cartridge 34*c* is in an idle state. At time TA, imaging apparatus 14 drives the ID line to ground (during period 112) to trigger multiple perforation cycles that begins at time TA. In this example, during period 112, from time TA to time TD, three perforation cycles are performed by perforator cartridge 34*c*: perforation cycle PC1 (between times TA and TB); perforation cycle PC2 (between times TB and TC); and perforation cycle PC3 (between times TC and TD). In this embodiment, during period 112, perforator cartridge 34*c* cannot communicate with controller 26 over the ID line. However, during period 114, from time TD to time TE, perforator cartridge 34*c* can communicate with controller 26 over the ID line, since the perforation cycles have been completed. Thus, during period 114, perforator cartridge 34*c* may drive the ID line to provide perforator cartridge 34*c* status information to controller 26 of imaging apparatus 14, such as for example, whether the perforation cycles are complete. At time TE, perforator cartridge 34*c* goes back to an idle state, i.e., period 116.

During periods of communication between controller 26 of imaging apparatus 14 and perforator cartridge 34*c*, a bit transmission may be triggered by the ID line being driven to a 50 percent duty cycle, which will be referred to as a "mark" state. A mark is used to separate each bit in the serial data stream from an adjacent bit. A 25 percent duty cycle of the PWM signal may represent a logic "0" (low) and a 100 percent duty cycle of the PWM signal may represent a logic "1" (high). Controller 26 of imaging apparatus 14 can abort a transmission and force perforator cartridge 34*c* to an idle state by sending a mark command followed by ground (zero (0) duty cycle) over the ID line. In the examples above, controller 26 sent an ID command, in the form of a PWM serial data string to perforator cartridge. It is further contemplated, however, that other commands may be sent to perforator cartridge 34*c* in a similar manner, such as for example, an initialize command, a shutdown command, etc.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for identifying an installed cartridge in a cartridge carrier of an imaging apparatus, said imaging apparatus communicating with said installed cartridge over at least one line, comprising:

determining an impedance of a first line coupled to said installed cartridge, wherein an impedance at a first level indicates that said installed cartridge is not a perforator cartridge, and an impedance at a second level indicates the possibility that said installed cartridge is said perforator cartridge; and if said impedance is at said second level, then performing an act of sending an ID command to said installed cartridge via an ID line; and monitoring said ID line for an affirmative response from said installed cartridge, wherein said affirmative response over said ID line indicates that said installed cartridge is said perforator cartridge.

2. The method of claim 1, further comprising, prior to the act of sending, monitoring said ID line for a predefined fixed logic level.

3. The method of claim 1, wherein said imaging apparatus triggers a perforation cycle of said perforator cartridge by driving said ID line to ground for a predetermined period of time.

4. The method of claim 3, wherein following a perforation cycle, said perforator cartridge sends perforator status information to said imaging apparatus via said ID line.

5. The method of claim 1, wherein bi-directional communications over said ID line occurs in the form of a pulse width modulated serial data stream.

6. The method of claim 1, wherein said ID line is also used to identify a printing cartridge using a different communication scheme.

7. An imaging apparatus, comprising:

a cartridge carrier having a cartridge bay having an electrical interface including an ID line, said cartridge carrier being configured to interchangeably receive one of a printing cartridge and a perforator cartridge;

said printing cartridge having electronic circuitry to facilitate an identification of said printing cartridge, said perforator cartridge having an internal electronic configuration that differs from that of said electronic circuitry of said printing cartridge;

a controller communicatively coupled to said electrical interface of said cartridge bay of said carrier and to an installed cartridge present in said cartridge bay, said controller executing program instructions to perform the acts of:

sending an ID command to said installed cartridge present in said cartridge bay via said ID line; and monitoring said ID line for an affirmative response from said installed cartridge, wherein said affirmative response over said ID line indicates that said installed cartridge is a perforator cartridge.

8. The apparatus of claim 7, said electrical interface including a temperature sense line, said controller executing program instructions to perform the further acts of, prior to the act of sending:

determining an impedance of said temperature sense line coupled to said installed cartridge, wherein an impedance at a first level indicates that said installed cartridge is not said perforator cartridge, and an impedance at a second level indicates the possibility that said installed cartridge is said perforator cartridge; and if said impedance is at said second level, then performing the act of sending said ID command.

9. The apparatus of claim 8, further comprising, prior to the act of sending, monitoring said ID line for a predefined fixed logic level.

10. The apparatus of claim 7, wherein said imaging apparatus triggers a perforation cycle of said perforator cartridge by driving said ID line to ground for a predetermined period of time.

11. The apparatus of claim 10, wherein following a perforation cycle, said perforator cartridge sends perforator status information to said imaging apparatus via said ID line.

12. The apparatus of claim 7, wherein bi-directional communications over said ID line occurs in the form of a pulse width modulated serial data stream.

13. The apparatus of claim 7, wherein said ID line is also used to identify said printing cartridge using a different communication scheme.

* * * * *

UNITED STATES PATENT AND TRADEMARK OFFICE

CERTIFICATE OF CORRECTION

PATENT NO. : 7,614,737 B2
APPLICATION NO. : 11/303275
DATED : November 10, 2009
INVENTOR(S) : Ahne et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 693 days.

Signed and Sealed this

Nineteenth Day of October, 2010

David J. Kappos

David J. Kappos
*Director of the United States Patent and Trademark Office*